US007677174B2

(12) United States Patent
Eckel et al.

(10) Patent No.: US 7,677,174 B2
(45) Date of Patent: Mar. 16, 2010

(54) METHOD FOR CLEANING AN ANILOX INKING UNIT

(75) Inventors: Dieter Eckel, Sandhausen (DE); Michael Fichtner, Plankstadt (DE); Michael Gross, Wiesloch-Baiertal (DE); Jürgen Michels, Dossenheim (DE); Rainer Rehn, Sandhausen (DE); Dieter Schaffrath, Lorsch (DE); Wolfgang Schönberger, Schriesheim (DE); Bernhard Schwaab, Neustadt (DE); Michael Thielemann, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 23 days.

(21) Appl. No.: 11/804,870

(22) Filed: May 21, 2007

(65) Prior Publication Data

US 2007/0266873 A1 Nov. 22, 2007

(30) Foreign Application Priority Data

May 19, 2006 (DE) ..... 10 2006 023 860
Mar. 1, 2007 (DE) ..... 10 2007 009 969

(51) Int. Cl.
*B41F 35/00* (2006.01)

(52) U.S. Cl. ..... 101/483; 101/425

(58) Field of Classification Search ..... 101/483, 101/425

See application file for complete search history.

(56) References Cited

U.S. PATENT DOCUMENTS

| | | | | |
|---|---|---|---|---|
| 6,047,640 | A | 4/2000 | Murakawa | |
| 6,672,211 | B2 * | 1/2004 | Price et al. | 101/483 |
| 6,752,077 | B2 * | 6/2004 | Kolbe et al. | 101/169 |
| 7,398,731 | B2 * | 7/2008 | Schonberger | 101/350.3 |

FOREIGN PATENT DOCUMENTS

| | | | |
|---|---|---|---|
| DE | 31 34 796 | C2 | 3/1983 |
| DE | 10 2004 005 576 | A1 | 9/2004 |
| DE | 10 2005 056 812 | A1 | 6/2006 |
| EP | 0 951 998 | B1 | 7/2003 |

* cited by examiner

*Primary Examiner*—Anthony H. Nguyen
(74) *Attorney, Agent, or Firm*—Laurence A. Greenberg; Werner H. Stemer; Ralph E. Locher

(57) ABSTRACT

In a method for cleaning an anilox inking unit, a doctor bears against a roller and an intermediate roller bears against the roller and on an engraved roller. During cleaning, the intermediate roller has been or is displaced axially. Because the intermediate roller can be displaced axially, edge regions of the engraved roller can also be cleaned during a cleaning operation.

6 Claims, 7 Drawing Sheets

METHOD FOR CLEANING AN ANILOX INKING UNIT

CROSS-REFERENCE TO RELATED APPLICATIONS

This application claims the priority, under 35 U.S.C. §119, of German applications DE 10 2006 023 860.5, filed May 19, 2006 and DE 10 2007 009 969.1, filed Mar. 1, 2007; the prior applications are herewith incorporated by reference in their entirety.

BACKGROUND OF THE INVENTION

Field of the Invention

The present invention relates to a method for cleaning an anilox inking unit.

In published, non-prosecuted German patent application DE 10 2004 005 576 A1, an anilox inking unit is described which contains an engraved roller, a cleaning roller, a metering doctor and a cleaning doctor. In printing operation, the printing ink is fed to the engraved roller by the metering doctor. During cleaning, the cleaning doctor bears on the cleaning roller and the cleaning roller bears on the engraved roller, so that printing ink is removed from the engraved roller via the cleaning roller and the cleaning doctor.

Metering doctors, like the metering doctors illustrated in the prior art, normally have a plate-like side seal in each case on the operating side and on the drive side of the printing press, which side seal bears on the engraved roller during printing operation. The side seals delimit at the sides the storage space in which the printing ink stored in the metering doctor is located. The cleaning of the edge regions of the engraved roller, which are underneath the side seals, is a problem which has not previously been treated in the aforementioned prior art.

SUMMARY OF THE INVENTION

It is accordingly an object of the invention to provide a method for cleaning an anilox inking unit which overcomes the herein-mentioned disadvantages of the heretofore-known methods of this general type, in which method the edge regions are also cleaned at the same time.

With the foregoing and other objects in view there is provided, in accordance with the invention, a method for cleaning an anilox inking unit. The method includes placing a doctor to bear against a roller; and axially displacing an intermediate roller with the intermediate roller bearing against the roller and an engraved roller.

In the method according to the invention for cleaning the anilox inking unit, the doctor bears on the roller and the intermediate roller bears on the roller and on an engraved roll. Furthermore, in the method according to the invention the intermediate roller has been or is displaced axially. The method according to the invention therefore includes two cases closely related to each other. In both cases, the intermediate roller is constructed such that it can be displaced axially and axial displacement of the intermediate roller is effected for the purpose of cleaning. In one case, the axial displacement of the intermediate roller is effected before the cleaning, the axial position of the intermediate roller set for the cleaning is maintained permanently during the cleaning. In the other case, the axial position of the intermediate roller is varied continuously or periodically during the cleaning.

One advantage of the method according to the invention is to be seen in the fact that, during the cleaning, edge regions of the engraved roller, which are located under side seals of a metering doctor or of an ink fountain, for example, can also be covered. The cleaning of the edge regions is possible although the axial length of the intermediate roller can be less than or equal to the distance between the side seals or between the edge regions. Such axial shortening of the intermediate roller is advantageous for the printing operation.

In one development, the intermediate roller is kept in a different axial position during cleaning than during the printing operation. In this case, the intermediate roller is preferably kept in a central axial position during the printing operation and in an outer axial position during the cleaning. In this case the intermediate roller is therefore aligned axially centrally relative to the engraved roller during the printing operation and, during the cleaning, the intermediate roller is located in a position pushed out of the central axial position. Here, the intermediate roller can be kept in the outer axial position by applying compressed air to an expansion chamber integrated into the intermediate roller. In addition, a further intermediate roller can bear on the roller and the engraved roller, and the intermediate roller and the further intermediate roller can be displaced axially in opposite directions relative to each other. For example, one of the two intermediate rollers can be displaced toward the operating side of the printing press and the other intermediate roller can be displaced toward the drive side. This antiparallel displacement of the two intermediate rollers exists only during the cleaning and not during the printing operation, during which the two intermediate rollers are located in the central position.

In a further development, the intermediate roller is made to oscillate during the cleaning. Accordingly, during the cleaning, the intermediate roller executes an axial to and fro movement. Provision is preferably made for the intermediate roller to be stopped axially during the printing operation; so that the oscillating movement is therefore interrupted during the printing operation. During the printing operation, the intermediate roller can be stopped in its central position.

The invention also includes a printing press which is constructed to carry out the method according to the invention or according to one of the developments.

Other features which are considered as characteristic for the invention are set forth in the appended claims.

Although the invention is illustrated and described herein as embodied in a method for cleaning an anilox inking unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
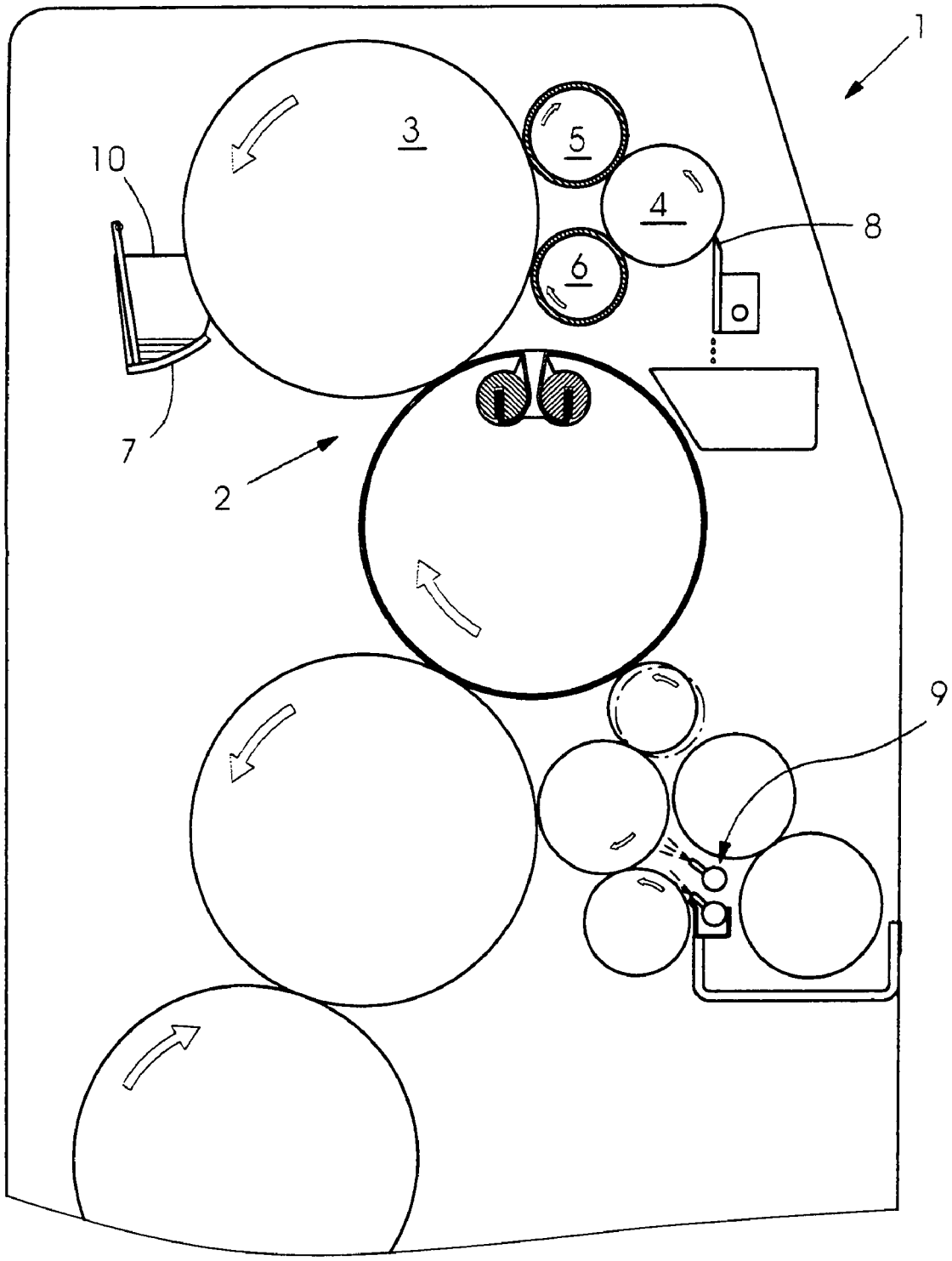
FIG. 1 is a diagrammatic, side sectional view of an anilox inking unit having intermediate rollers according to the invention.

In FIGS. 1-9, mutually corresponding elements and components are designated by the same designations. In addition, the terms roll(s) and roller(s) are considered one and the same. Referring now to the figures of the drawing in detail and first, particularly, to FIG. 1 thereof, there is shown a printing press 1 for offset lithographic printing. The printing press 1 contains an anilox inking unit 2 having an engraved roller 3, a roller 4, a first intermediate roller 5 and a second intermediate roller 6. The engraved roller 3 is in rolling contact with both intermediate rollers 5, 6, and the two intermediate rollers 5, 6 are simultaneously in rolling contact with the roller 4. The roller 4 is driven in rotation by a form fit and is a distributor roller which oscillates axially. In the printing operation, an ink feed device 7 is set against the engraved roller 3. The ink feed device 7 can be a chamber type doctor or—as shown—a doctor type fountain and functions as a metering doctor. During cleaning of the anilox inking unit 2, a doctor 8 functioning as a cleaning doctor is set against the roller 4. The designation 9 designates a spraying device, by which the detergent and water required for the cleaning operation is introduced into the anilox inking unit 2.

Figure 2:
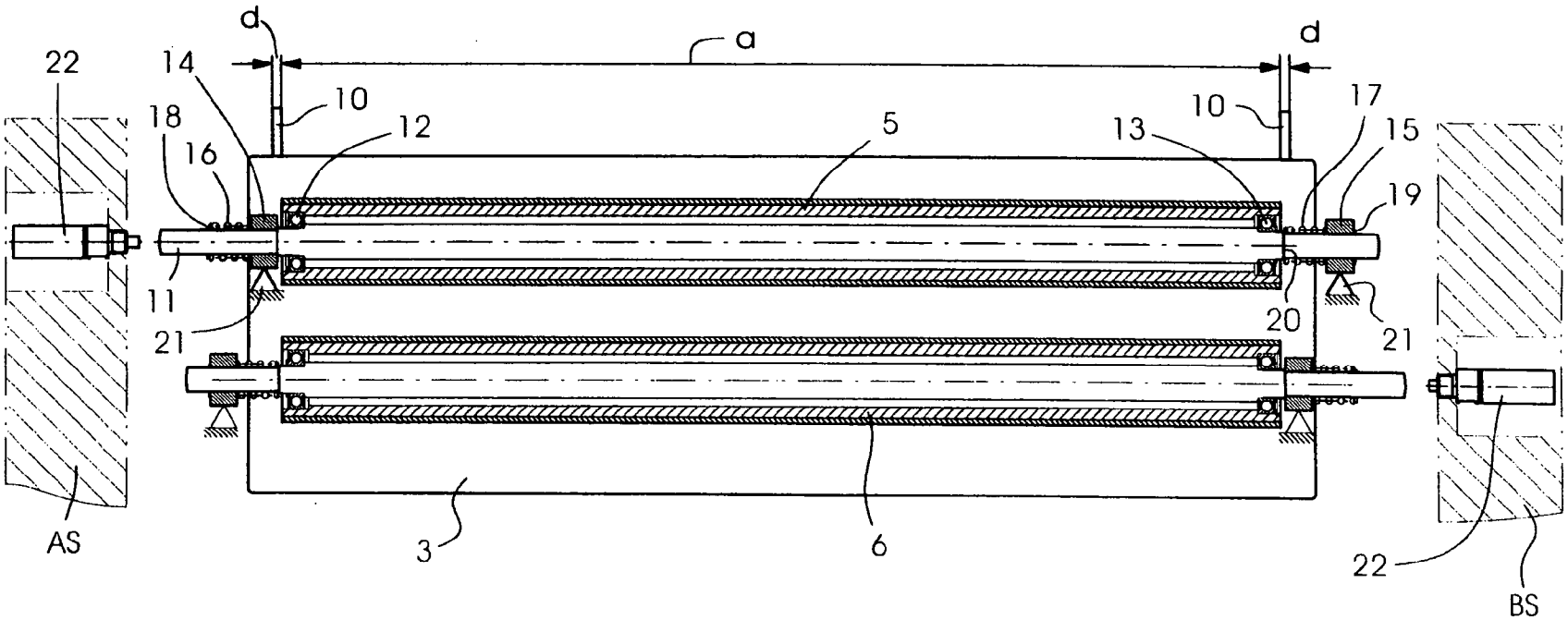
FIG. 2 is a diagrammatic, sectional view of the intermediate rollers shown in FIG. 1 in a central position provided for a printing operation.

FIG. 2 shows that the ink feed device 7 contains plate-like side seals 10, of which one is located in an edge region of the engraved roller 3 located on a drive side AS and the other is located in an edge region of the engraved roller 3 located on an operating side BS. A thickness of the side seals 10 is designated by the designation d, and the distance existing between the side seals 10 is designated by the designation a.

Since the mounting of the second intermediate roller 6 with respect to a central plane which extends at right angles to axes of rotation of the rollers is constructed mirror symmetrically with respect to the mounting of the first intermediate roller 5, described in detail below, the description of the one mounting also applies in the transferred sense to the other mounting.

The intermediate roller 5 is rotatably mounted on an axle 11 via rotary bearings 12, 13. The rotary bearings 12, 13 are antifriction bearings, the rotary bearing 12 located on the drive side AS being a fixed bearing, so that the intermediate roller 5 is secured against displacement on the axle 11. The rotary bearing 13 located on the operating side BS is a loose bearing. The axle 11 can be a fixed axle which does not rotate. Secured in roller locks 21, indicated only schematically, are bearing rings 14, 15, into which the axle 11 is inserted such that it can be displaced.

A compression spring 16 is supported with its one end via a support 18 on the axle 11 and with its other end on the bearing ring 14. The bearing ring 14 located on the drive side AS is located between the compression spring 16 and the intermediate roller 5. Arranged on the operating side BS is a further compression spring 17, which is supported with its one end on the axle 11 via a collar 20 of the latter and is supported with its other end on the bearing ring 15, which serves as a stop for a support 19. The support 19 serves as a securing element for limiting the magnitude of an axial displacement of the axle 11, still to be explained below. The supports 18, 19 can be securing washers seated on the axle 11 or transverse pins inserted into the axle 11.

Figure 3:
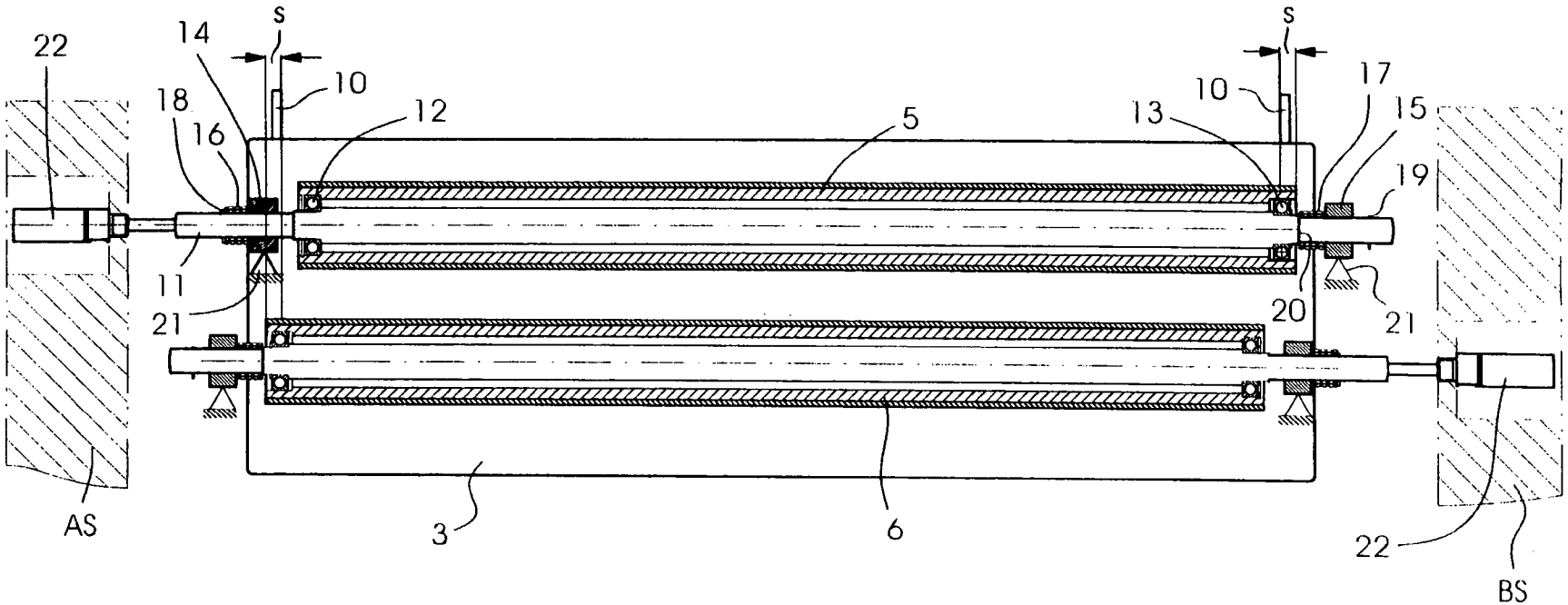
FIG. 3 is a diagrammatic, sectional view of the intermediate rollers shown in FIG. 1 in outer positions provided for a cleaning operation.

Arranged on the drive side AS is an actuating drive 22, which is able to displace the axle 11 together with the intermediate roller 5 mounted thereon out of the central position shown in FIG. 2 into the outer position shown in FIG. 3, by the actuating drive 22 pressing on the axle 11. In the exemplary embodiment shown, the actuating drive 22 is constructed as a pneumatic operating cylinder, whose piston rod does not press on the axle 11 when it is in its retracted state, as shown in FIG. 2, and presses on the axle 11 when it is in the extended state, as shown in FIG. 3.

Instead of the operating cylinder, an eccentric that can be rotated by a motor or manually could also be provided.

The actuating drive 22 is fixed to a machine wall located on the drive side AS. As can be seen from FIG. 2, not only the first intermediate roller 5 but also the second intermediate roller 6 is assigned such an actuating drive 22. Because of the mutually mirror symmetrical construction of the two intermediate rollers 5, 6 already mentioned, it goes without saying that the actuating drive 22 assigned to the second intermediate roller 6 must be located on the operating side. Furthermore, FIG. 2 reveals that the two intermediate rollers 5, 6 have one and the same axial length, which is exactly the same size as the distance a existing between the side seals 10.

The apparatus illustrated in FIGS. 2 and 3 functions as now described.

FIG. 2 shows that, in printing operation, the intermediate rollers 5, 6 are located in their central position, so that the intermediate rollers 5, 6 do not project axially into the region of the side seals 10 determined by the thickness d. In this edge region of the engraved roller 3 determined by the thickness d, however, printing ink collects during the printing operation and must be removed during cleaning. As illustrated in FIG. 1, the cleaning of the engraved roller 3 is carried out by the residual ink located on the engraved roller 3 being removed from the engraved roller 3 by the intermediate rollers 5, 6 and being removed from the intermediate rollers 5, 6 by the roller 4, in order ultimately to be able to be doctored off the roller 4 by the doctor 8.

FIG. 3 illustrates the fact that, during the cleaning of the engraved roller 3, the actuating drives 22 are activated, so that the intermediate rollers 5, 6 are kept in mutually opposite outer positions. The actuating drives 22 keep the intermediate rollers 5, 6 in the outer positions counter to the restoring actions of the compression springs 16, 17. In this case, the axle 11 of the first intermediate roller 5, together with the latter, is displaced by the actuating drive 22 assigned to the first intermediate roller 5 by an actuating travel designated by the designation s from the central position toward the operating side BS into the outer position and kept in the latter. In addition, the axle 11 of the second intermediate roller 6, together with the latter, is displaced by the actuating drive 22 assigned to the second intermediate roller 6 by an equally large actuating travel s from the central position toward the drive side into the outer position. The respective actuating travel s is somewhat greater than the thickness d of the side seal 10.

As a result of the mutually opposite axial displacement of the intermediate rollers 5, 6, the first intermediate roller 5 is displaced into the edge region of the engraved roller 3 which is located under the side seal 10 on the operating side, and the second intermediate roller 6 is displaced into the other edge region of the engraved roller 3 which is located under the side seal 10 on the drive side AS. During the cleaning, the intermediate rollers 5, 6 are kept permanently in their outer positions illustrated in FIG. 3, the intermediate rollers 5, 6 removing from the engraved roller 3 the residual ink that has collected between the side seals 10 and the engraved roller 3, so that the engraved roller 3 is also cleaned in its soiled edge regions and not just in its immediate inking region determined by the distance a.

In FIGS. 4 to 7, an exemplary embodiment is shown in which the second intermediate roller 6 has been omitted. In the second exemplary embodiment, the intermediate roller 5 is mounted on the axle 11 such that it can oscillate. The oscillating movement of the roller 5 which takes place during cleaning (see FIGS. 6 and 7) is driven exclusively via circumferential surface friction by the roller 4, which—as already explained—bears on the intermediate roller 5. The roller 4 executes an oscillating movement, which is carried out over a distributor roller traversing travel $s_R$ toward the drive side AS and over an equally large distributor roller traversing travel $s_R$ toward the operating side BS in relation to the central roller position. This oscillating movement of the roller 4 is driven by a form fit via a driver 23. The driver 23 is a roller and engages in a circumferential groove in the axle journal of the roller 4.

Figure 5:
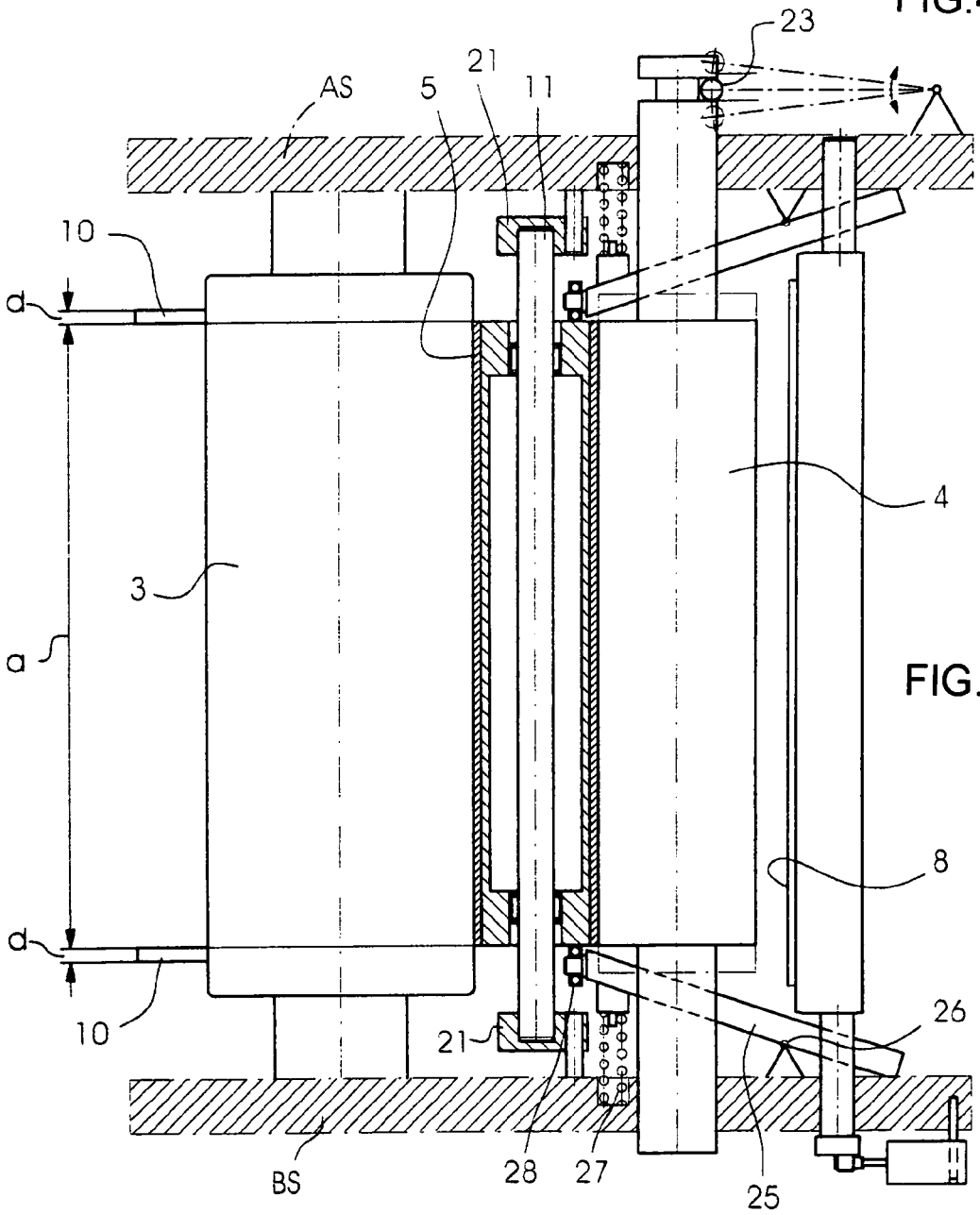
FIG. 5 is a diagrammatic, top and sectional view in parts showing the modification of the anilox inking unit from FIG. 1 during the printing operation.
Figure 6:
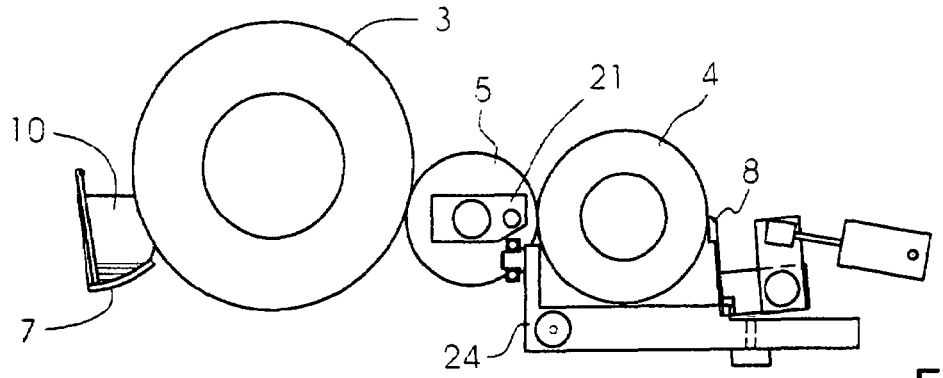
FIG. 6 is a diagrammatic, side view showing a modification from FIGS. 4 and 5 during the cleaning of the anilox inking unit.
Figure 7:
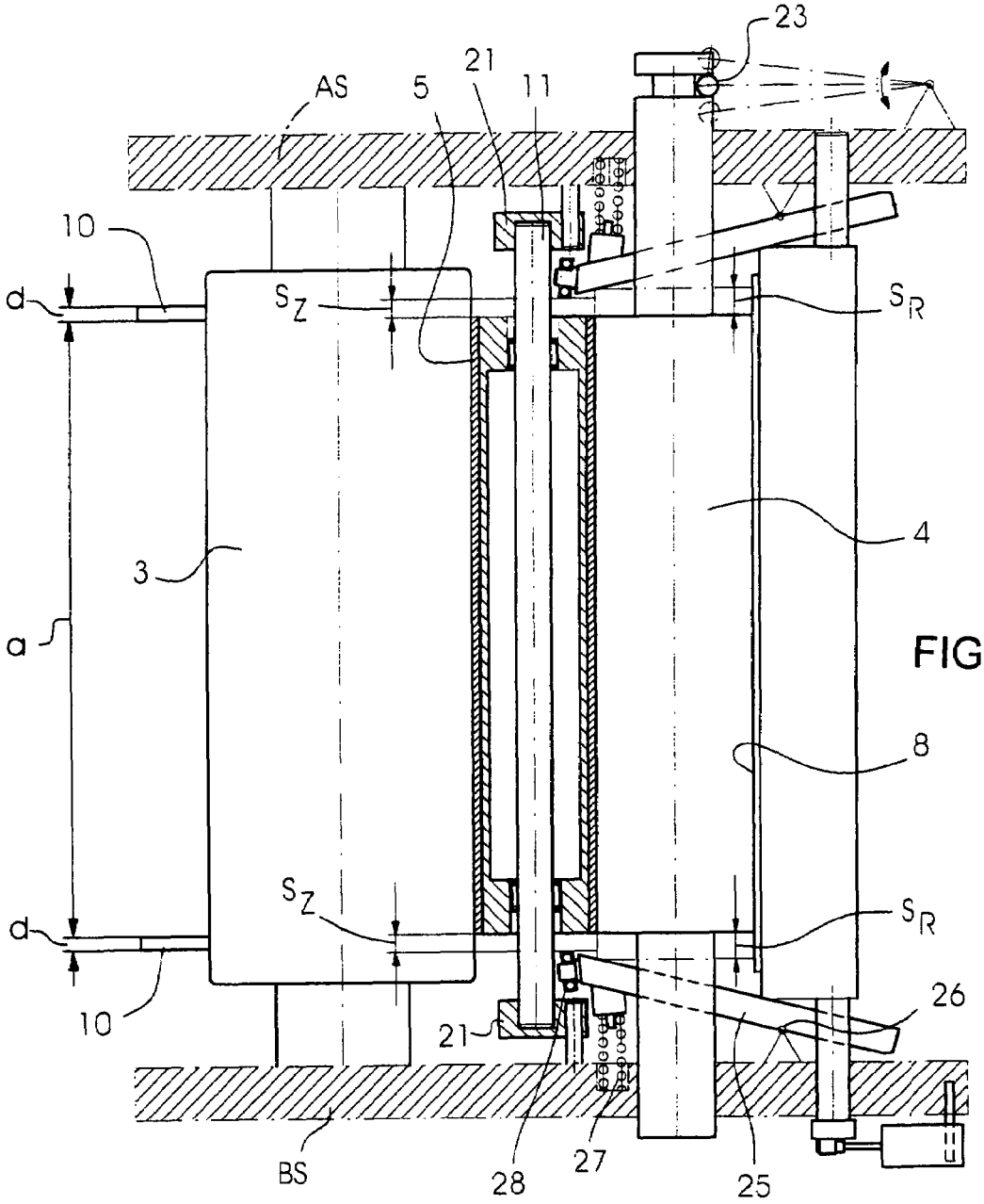
FIG. 7 is a diagrammatic, top and sectional view in parts showing the modification from FIGS. 4 and 5 during the cleaning of the anilox inking unit.

The intermediate roller 5 is assigned a fixing device 24, which blocks the oscillating movement of the intermediate roller 5 as desired in printing operation (see FIGS. 4 and 5) and releases it during cleaning (see FIGS. 6 and 7). The fixing device 24 contains a lever 25 in each case on the drive side AS and on the operating side BS, which lever can be pivoted about a joint 26 whose geometric axis is oriented transversely with respect to the axes of rotation of the rolls 3, 4, 5. The respective lever 25 is loaded by a spring 27, which tends to force the lever 25 toward the intermediate roller 5, so that the lever 25 bears via a running roller 28 on a lateral planar surface of the intermediate roller 5.

Figure 4:
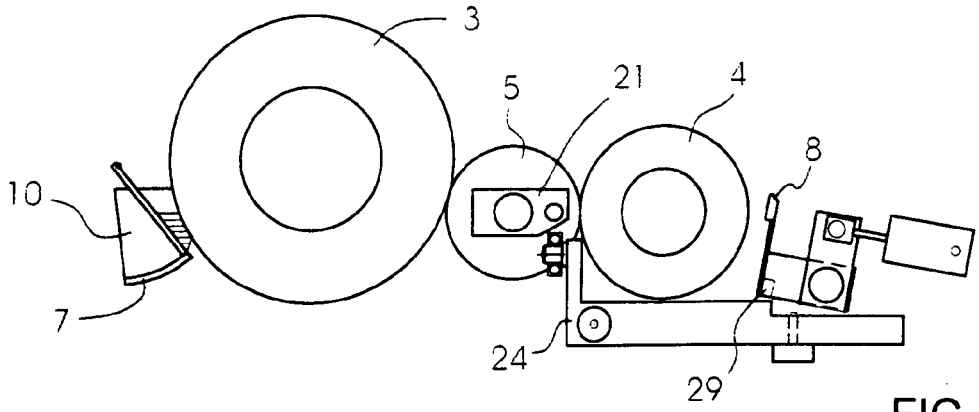
FIG. 4 is a diagrammatic, side view showing a modification of the anilox inking unit from FIG. 1 during the printing operation.

FIGS. 4 and 5 show the printing operation, the springs 27 being somewhat unstressed and keeping the levers 25 in contact with the intermediate roller 5 via the running rollers 28, so that the intermediate roller 5 is kept in its central position by the levers 25 and is stopped with respect to its axial movement. On account of the blocking action of the fixing device 24, the intermediate roller 5 is not carried along in the axial direction by the oscillating roller 5 in printing operation. With regard to their stiffness, the springs 27 are dimensioned in such a way that they withstand the axial forces transmitted frictionally from the roller 4 to the intermediate roller 5, so that the intermediate roller 5 is not able to force away the lever 25 bearing on it. In its central position illustrated in FIGS. 4 and 5, the intermediate roller 5 is located between the side seals 10, because of its axial shortness.

For the cleaning mode, the fixing device 24 is switched over, so that the levers 25 are pivoted away from the intermediate roller 5, so that, on the drive side AS and on the operating side BS, between the respective lever 25 or its running roller 28 and the intermediate roller 5, there results a clearance, which is designated the intermediate roller traversing travel $s_Z$, for the oscillating movement of the intermediate roller 5.

In FIGS. 6 and 7, it can be seen that the intermediate roller traversing travels $s_Z$ are dimensioned such that, in the course of its oscillating movement, the intermediate roller 5 is able to sweep over the edge regions of the engraved roller 3 located under the side seals 10. However, the intermediate roller traversing travels $s_Z$ are somewhat shorter than the distributor roller traversing travels $s_R$ of the roller 4 which, in the cleaning mode, frictionally drives the oscillating movement of the intermediate roller 5 released by the fixing device 24. As a consequence of the fact that the intermediate roller 5 also oscillates into the edge regions of the engraved roller 3 located at the level of the side seals 10 when in cleaning mode, ink residues located there are removed from the engraved roller 3 by the intermediate roller 5. These ink residues, together with the ink residues from the regions of the engraved roller 3 located between the side seals 10, are removed by the intermediate roller 5 and transferred to the roller 4, from which all the ink residues are doctored off by the doctor 8.

In order to set the doctor 8 against the roller 4, the doctor 8 is pivoted from its passive position, shown in FIG. 4, into the active position shown in FIG. 6. This can be done manually or—as illustrated in the drawing—by an actuating drive. During this setting movement, the doctor 8 or its holder forces the levers 25 apart via bevels 29 formed thereon, so that the levers relinquish their blocking of the oscillating movement of the intermediate roller 5. The bevels 29 come into contact with the levers 25 as the doctor 8 is pivoted, press on the levers 25 in the manner of a wedge mechanism and spread the levers apart counter to the restoring action of the springs 27. Thus, the doctor 8 and the fixing device 24 can advantageously be actuated by the same actuating drive or, in the case of manual actuation, via one and the same handgrip.

Figure 8:
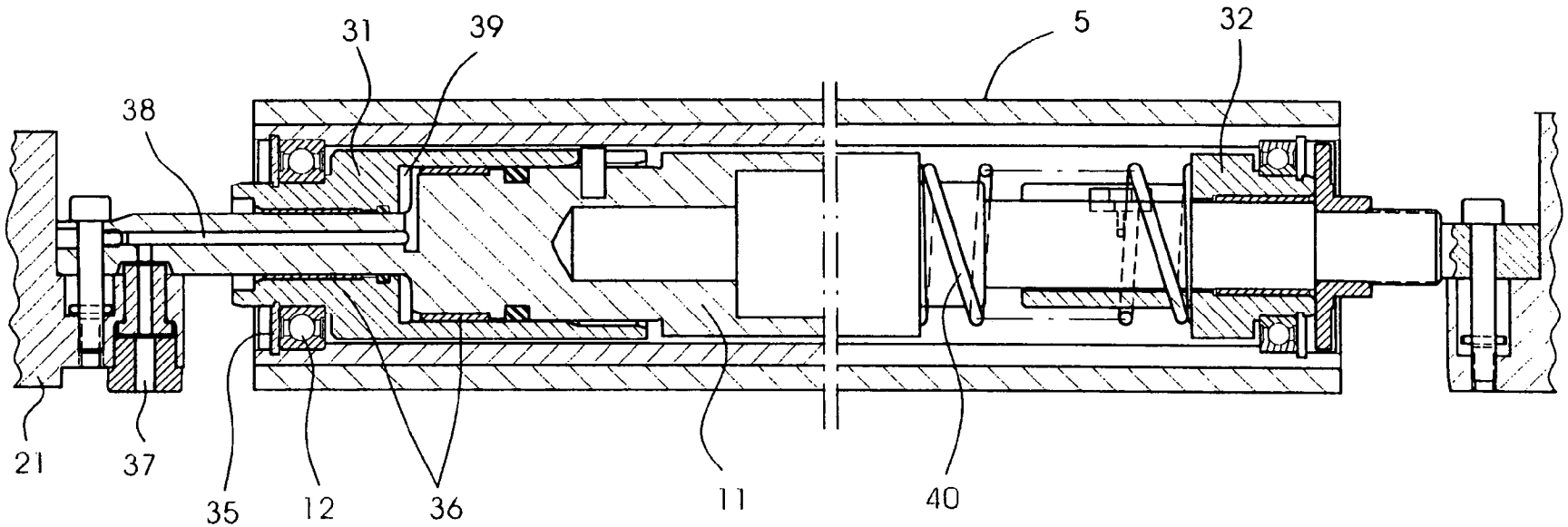
FIG. 8 is a diagrammatic, sectional view showing a modification of the intermediate rollers from FIGS. 2 and 3.
Figure 9:
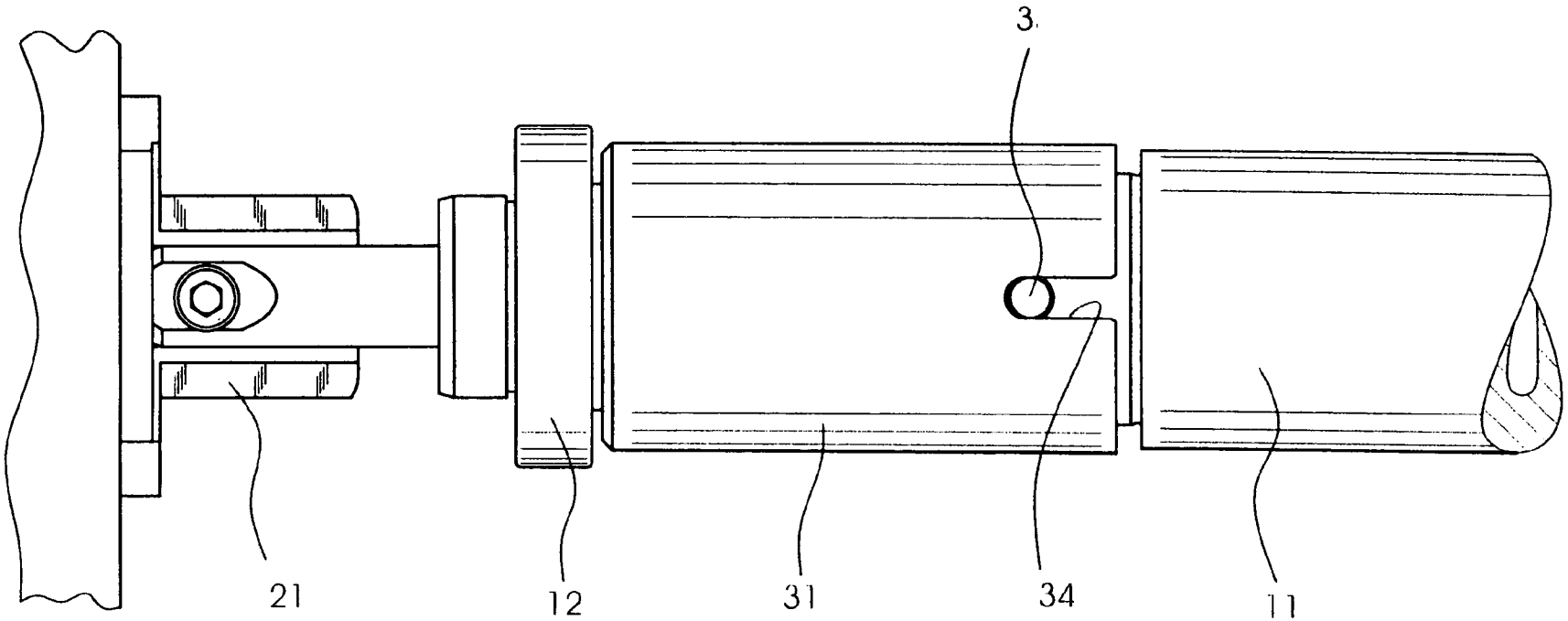
FIG. 9 is a diagrammatic, side view showing the modification of the intermediate rollers from FIGS. 2 and 3.

In FIGS. 8 and 9, a possible embodiment of the intermediate rollers 5 and 6 is illustrated by using the example of the intermediate roller 5. Here, the axle 11 is a fixed axle, which is detachably screwed fast in the roller lock 21, so that it does not rotate in the printing operation. The sleeve-like or tubular intermediate roller 5 is mounted on the axle 11 such that it can rotate and be displaced axially. Seated on the axle 11 such that they can be displaced axially but are secured against rotation are a first sliding bush 31 and a second sliding bush 32.

FIG. 9 shows the axle 11 and the first sliding bush 31 with the intermediate roller 5 missing in plan view, so that it is possible to see that the securing of the first sliding bush 31 against rotation is provided by a transverse pin 33 which is seated firmly in the axle 11 and which engages in a substantially U-shaped axial groove 34 in the edge of the first sliding bush 31.

The intermediate roller 5 is mounted on the first sliding bush 31 such that it can rotate via the rotary bearing (antifriction bearing) 12, the first sliding bush 31 and the intermediate roller 5 being secured against axial movement relative to each other by a securing ring 35 and a step located opposite the latter on the first sliding bush 31. During a common axial movement of the intermediate roller 5 and the first sliding bush 31, the latter slides along the axle 11, which can be provided with plastic bushes 36 for the purpose, and the transverse pin 33 slides along the axial groove 34.

The roller lock 21 is provided with a connection 37 for compressed air which, when the axle 11 is inserted into the roller lock 21, aligns with a transverse bore introduced into the axle 11, which opens into a longitudinal bore introduced into the axle 11. The transverse bore and the longitudinal bore together form a duct 38 for the compressed air flowing out of the connection 37 into the axle 11. This duct 38 opens into an expansion chamber 39 to which compressed air can be applied and which is bounded by a base of the first sliding bush 31 and an opposite step on the axle 11. In order to displace the intermediate roller 5 into its outer axial position illustrated in FIG. 3 and to keep it in this position, the expansion chamber 39 is pressurized with compressed air via the duct 38, which results in that the first sliding bush 31 together with the intermediate roller 5 is forced away from the step on the axle 11 counter to the action of a restoring spring 40. During this pneumatic displacement of the intermediate roller 5, the first sliding bush 31 and the axle 11 interact like the cylinder and the piston of an operating cylinder.

The restoring spring 40 is a helical spring that can be loaded in compression. The restoring spring 40 integrated into the intermediate roller 5 is prestressed between the second sliding bush 32 that can be displaced axially together with the intermediate roller 5 and a step on the axle 11. When the application of compressed air to the expansion chamber 39 is stopped, the restoring spring 40 forces the intermediate roller 5 and, with the latter, the two sliding bushes 31, 32 back into the initial axial position again—that is to say the central position of the intermediate roller 5 (see FIG. 2).

The construction of the intermediate roller 5 with pneumatic piston-cylinder unit integrated into it as an actuator for the eccentric displacement of the intermediate roller 5 is advantageous from many points of view. The intermediate roller 5 can be switched axially into its active position set against the engraved roller 3 (see FIG. 1) and into its passive position set off the latter, and also into any position located in between. Additional overall space outside the intermediate roller 5 is not needed; a compact configuration is provided.

The invention claimed is:

1. A method for cleaning an anilox inking unit, which comprises the steps of:

placing a doctor to bear against a roller;

keeping an intermediate roller in contact with the roller and an engraved roller during a cleaning operation;

axially displacing the intermediate roller along a rotational axis of the intermediate roller into different axial positions; and keeping the intermediate roller in a different axial position during the cleaning operation than during a printing operation.

2. The method according to claim 1, wherein the intermediate roller is in a central axial position during the printing operation and the intermediate roller is in an outer axial position during the cleaning operation.

3. The method according to claim 1, which further comprises displacing the intermediate roller and a further intermediate roller axially in opposite directions relative to each other, the further intermediate roller bearing against the roller and the engraved roller.

4. The method according to claim 1, which further comprises oscillating the intermediate roller during the cleaning operation.

5. The method according to claim 4, which further comprises stopping the intermediate roller axially during the printing operation.

6. The method according to claim 2, which further comprises keeping the intermediate roller in the outer axial position by applying compressed air to an expansion chamber located within the intermediate roller.

* * * * *